US009120590B2

(12) United States Patent
Roubal et al.

(10) Patent No.: US 9,120,590 B2
(45) Date of Patent: Sep. 1, 2015

(54) ASEPTIC TRANSFER BEAD FOR PLASTIC CONTAINERS

(75) Inventors: Edward Roubal, Stewartstown, PA (US); Larry Taylor, Landisville, PA (US)

(73) Assignee: GRAHAM PACKAGING COMPANY, L.P, York, PA (US)

( * ) Notice: Subject to any disclaimer, the term of this patent is extended or adjusted under 35 U.S.C. 154(b) by 0 days.

(21) Appl. No.: 13/488,886

(22) Filed: Jun. 5, 2012

(65) Prior Publication Data

US 2012/0240523 A1 Sep. 27, 2012

Related U.S. Application Data

(62) Division of application No. 12/047,700, filed on Mar. 13, 2009, now abandoned.

(51) Int. Cl.

| | |
|---|---|
| ***B65B 1/04*** | (2006.01) |
| ***B65B 55/00*** | (2006.01) |
| ***B65B 55/10*** | (2006.01) |
| ***B65D 1/02*** | (2006.01) |

(52) U.S. Cl.

CPC ..... *B65D 1/0246* (2013.01); *B65B 55/00* (2013.01); *B65B 55/10* (2013.01)

(58) Field of Classification Search

CPC ..... B29B 2911/1402; B29B 2911/14026; B29B 2911/14326; B65D 1/023; B65D 1/0246

USPC ..... 53/426, 425, 467, 167; 215/40–55

See application file for complete search history.

(56) References Cited

U.S. PATENT DOCUMENTS

| | | | | |
|---|---|---|---|---|
| 3,900,120 | A | 8/1975 | Sincock | |
| 6,105,800 | A | 8/2000 | Czesak | |
| 6,959,830 | B1 | 11/2005 | Kanou et al. | |
| 7,207,451 | B2 | 4/2007 | Taylor et al. | |
| 2002/0017501 | A1 | 2/2002 | Clements et al. | |
| 2002/0083682 | A1 * | 7/2002 | Edwards et al. | 53/426 |
| 2004/0108295 | A1 | 6/2004 | Schumann | |
| 2005/0218103 | A1 | 10/2005 | Barker et al. | |
| 2007/0051688 | A1 * | 3/2007 | Dygert et al. | 215/44 |
| 2007/0289933 | A1 | 12/2007 | Weissmann et al. | |
| 2009/0078668 | A1 * | 3/2009 | Kraft | 215/44 |

* cited by examiner

*Primary Examiner* — Stephen F Gerrity
*Assistant Examiner* — Eyamindae Jallow
(74) *Attorney, Agent, or Firm* — Baker Botts L.L.P.

(57) ABSTRACT

A plastic container includes a neck with an opening to an interior of the container, where the neck opening having a first diameter and a second diameter of different lengths. A shoulder portion surrounds the neck of the plastic container. A transfer bead is located on the neck above the shoulder portion where the first diameter of the neck opening is above the transfer bead and the second diameter is below the transfer bead. The transfer bead is advantageously shaped and sized so as to facilitate application and removal of a sterilization solution during the aseptic packaging process.

16 Claims, 4 Drawing Sheets

ASEPTIC TRANSFER BEAD FOR PLASTIC CONTAINERS

This is a divisional of U.S. patent application Ser. No. 12/047,700, filed Mar. 13, 2008, the entire disclosure of which is hereby incorporated by reference as if set forth fully herein.

BACKGROUND OF THE INVENTION

1. Field of the Invention

The present invention relates generally to an aseptic transfer bead for plastic containers, and more particularly to a transfer bead that provides the functionality of a standard transfer bead, as well as meeting the aseptic requirements that are applicable to the packaging of certain types of foods and beverages.

2. Description of the Related Technology

Transfer beads that are generally embodied as an annular projection extending from the neck or finish portion of a container are widely used in the packaging industry in order to provide a purchase location for certain types of conveying and handling equipment.

Certain types of beverages such as milk require sterile packaging. This can be accomplished by using the well-known hot fill process or through the use of aseptic packaging technology. The latter tends to be quite popular in Europe and is gaining popularity in other parts of the world as well. The aseptic packaging process is characterized by a sterilization procedure in which the container is sprayed or immersed in a sterilization fluid and then rinsed in a sterile environment before the product is injected into the container. In order to avoid contamination of the beverage that is being packaged, it is particularly important that the container be adequately rinsed after it has been exposed to the sterilization fluid.

Plastic containers for packaging beverages such as milk are typically formed using the extrusion blow molding process, in which the container is formed from a continuously extruded tube known as a parison that is periodically captured and inflated within a moving mold assembly, typically a mold wheel.

In order to form a transfer bead on the neck of a container that is being fabricated using such a process, it is necessary for the inner portion of the wall of the neck of the container to be bent outwardly in congruence with the shape of the intended annular projection of the transfer bead on the outer surface of the neck of the container. This creates a relatively thin, narrow annular passage that is in communication with the interior of the container neck. Unfortunately, the relative inaccessibility of this passage sometimes prevents the sterilization fluid from fully penetrating into the entire depth of the passage. Even when the sterilization fluid does manage to fully penetrate the passage, the sterilization fluid that is used in the aseptic packaging process tends to become trapped in this relatively inaccessible passage and is difficult to rinse out adequately enough to ensure that unwanted sterilization fluid does not end up in the packaged product.

It is clear that a need exists for an improved blow molded container that has a transfer bead for use of handling and that is also more suitable for use with the aseptic packaging process than were the conventional containers described above.

SUMMARY OF THE INVENTION

Accordingly, it is an object of the invention to provide an improved blow molded container that has a transfer bead for use of handling and that is also more suitable for use with the aseptic packaging process than were the conventional containers described above.

In order to achieve the above and other objects of the invention, a plastic container according to a first aspect of the invention includes a main body portion; and a neck portion having a sidewall that defines an inner surface and an outer surface, the neck portion having a central longitudinal axis, the neck portion further having a transfer bead defined therein, the transfer bead being defined by a first upper annular portion of the sidewall, the first upper annular portion having a first outer surface that when viewed in longitudinal cross-section defines a first angle with respect to a horizontal plane that is perpendicular to the central longitudinal axis; a second lower annular portion of the sidewall, the second lower annular portion of the sidewall having a second outer surface that when viewed in longitudinal cross-section defines a second angle with respect to the horizontal plane; and an outer annular portion of the sidewall that is oriented so as to be substantially parallel to the central longitudinal axis, the outer annular portion of the sidewall being connected to the first upper annular portion of the sidewall at an upper end thereof and to the second lower annular portion of the sidewall at a lower end thereof, the outer annular portion of said sidewall extending for a first height; and wherein the first angle is greater than said second angle.

According to a second aspect of the invention, a plastic container includes a main body portion; and a neck portion having a sidewall that defines an inner surface and an outer surface, the neck portion having a central longitudinal axis, the neck portion further having a transfer bead defined therein, the transfer bead being defined by a first upper annular portion of the sidewall, the first upper annular portion having a first outer surface that when viewed in longitudinal cross-section defines a first angle with respect to a horizontal plane that is perpendicular to the central longitudinal axis; a second lower annular portion of the sidewall, the second lower annular portion of the sidewall having a second outer surface that when viewed in longitudinal cross-section defines a second angle with respect to the horizontal plane; and an outer annular portion of the sidewall that is oriented so as to be substantially parallel to the central longitudinal axis, the outer annular portion of the sidewall being connected to the first upper annular portion of the sidewall at an upper end thereof and to the second lower annular portion of the sidewall at a lower end thereof, the outer annular portion of the sidewall extending for a first height; and wherein the neck portion further has a first diameter above the transfer bead and a second diameter that is different from the first diameter below the transfer bead.

A method of aseptically packaging a beverage according to a third aspect of the invention includes steps of forming a container that has a neck portion having a sidewall that defines an inner surface and an outer surface, the neck portion having a central longitudinal axis, the neck portion further having a transfer bead defined therein, the transfer bead being defined by a first upper annular portion of the sidewall, the first upper annular portion having a first outer surface that when viewed in longitudinal cross-section defines a first angle with respect to a horizontal plane that is perpendicular to the central longitudinal axis; a second lower annular portion of the sidewall, the second lower annular portion of the sidewall having a second outer surface that when viewed in longitudinal cross-section defines a second angle with respect to the horizontal plane; and an outer annular portion of the sidewall that is oriented so as to be substantially parallel to the central longitudinal axis, the outer annular portion of the sidewall being connected to the first upper annular portion of the sidewall at an upper end thereof and to the second lower annular portion of the sidewall at a lower end thereof, the outer annular portion of said sidewall extending for a first height; and wherein the first angle is greater than the second angle; applying a sterilization fluid to an interior of the container; rinsing the container; and packaging a beverage within the aseptic container.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE PREFERRED EMBODIMENT(S)

Figure 1:
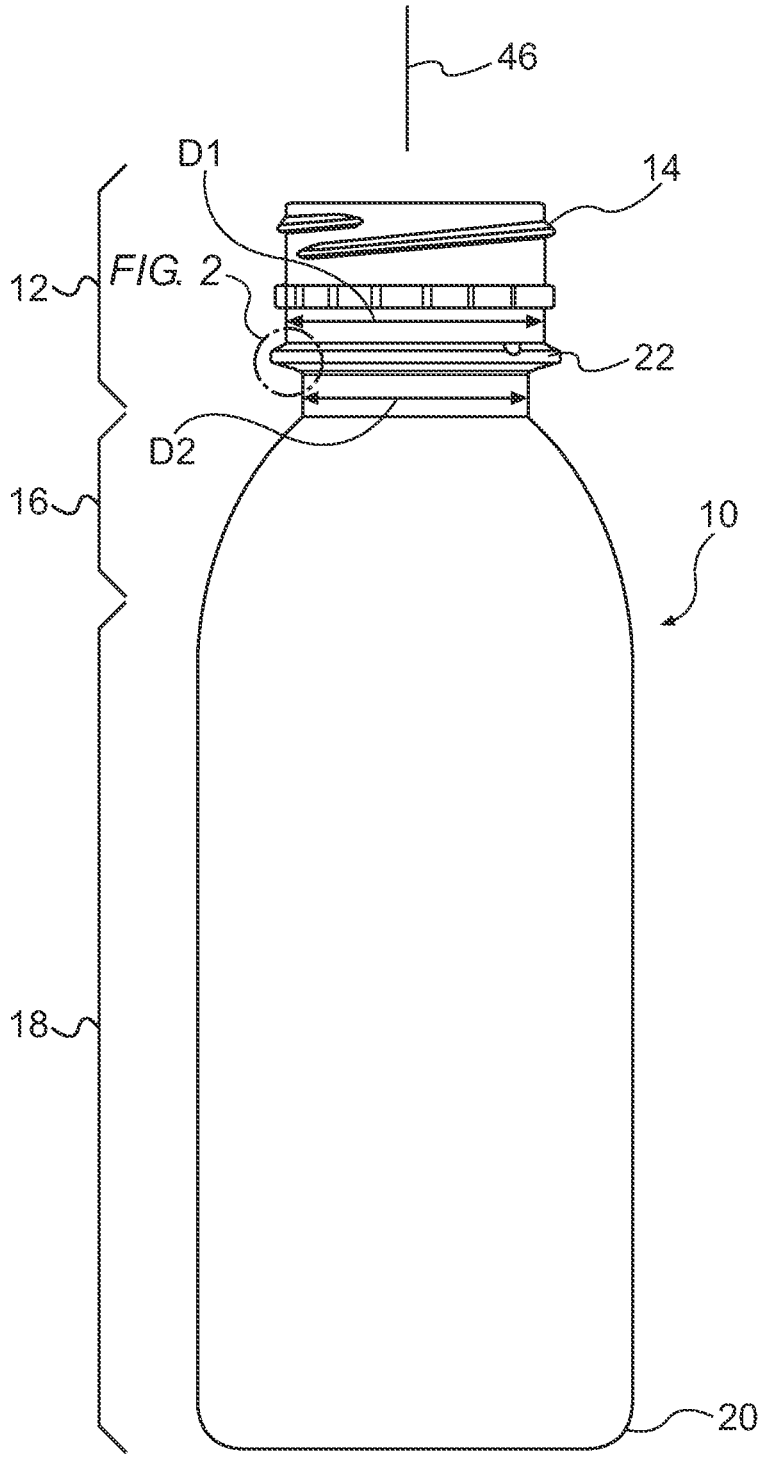
FIG. 1 is a diagrammatical side elevational view a plastic container that is constructed according to a preferred embodiment of the invention.

Referring now to the drawings, wherein like reference numerals designate corresponding structure throughout the views, and referring in particular to FIG. 1, a plastic container 10 according to a preferred exemplary embodiment of the invention is shown. The container 10 can be used to package a wide variety of liquid, viscous or solid products including, for example, juices, other beverages, yogurt, sauces, pudding, lotions, soaps in liquid or gel form, and bead shaped objects such as candy. The present container can be made by conventional blow molding processes including, for example, extrusion blow molding, stretch blow molding and injection blow molding.

Container 10 has a neck portion 12 that defines an opening to the interior of container 10. In the illustrated embodiment, neck 12 is styled as a threaded finish portion 14 that is constructed and arranged for receiving a closure that is not shown. A shoulder portion 16 extends outwardly from the circumference of neck portion 12 to a main body portion 18 where the shoulder portion 16 and body portion 18 form the sidewalls of the container 10. A base 20 is formed at the bottom of body portion 18. The size and shape of the interior surfaces of the respective portions of the sidewall of the container 10 determine the amount of volume that is available for adding a product to the container 10.

A transfer bead 22 is formed within the neck portion 12 and is shaped as an annular projection that extends outwardly from the surrounding portions of the neck portion 12 about an entire circumference of the neck portion 12. The sidewall of the neck portion 12 preferably has a substantially constant thickness, including those portions that define the transfer bead 22, and has an outer surface 42 and an inner surface 44. The substantially constant thickness is preferably within a range of about 0.025 inches to about 0.040 inches.

Neck portion 12 is preferably shaped so as to be generally cylindrical except as is otherwise described below and defines a longitudinal axis 46, as is shown in FIG. 1.

Figure 2:
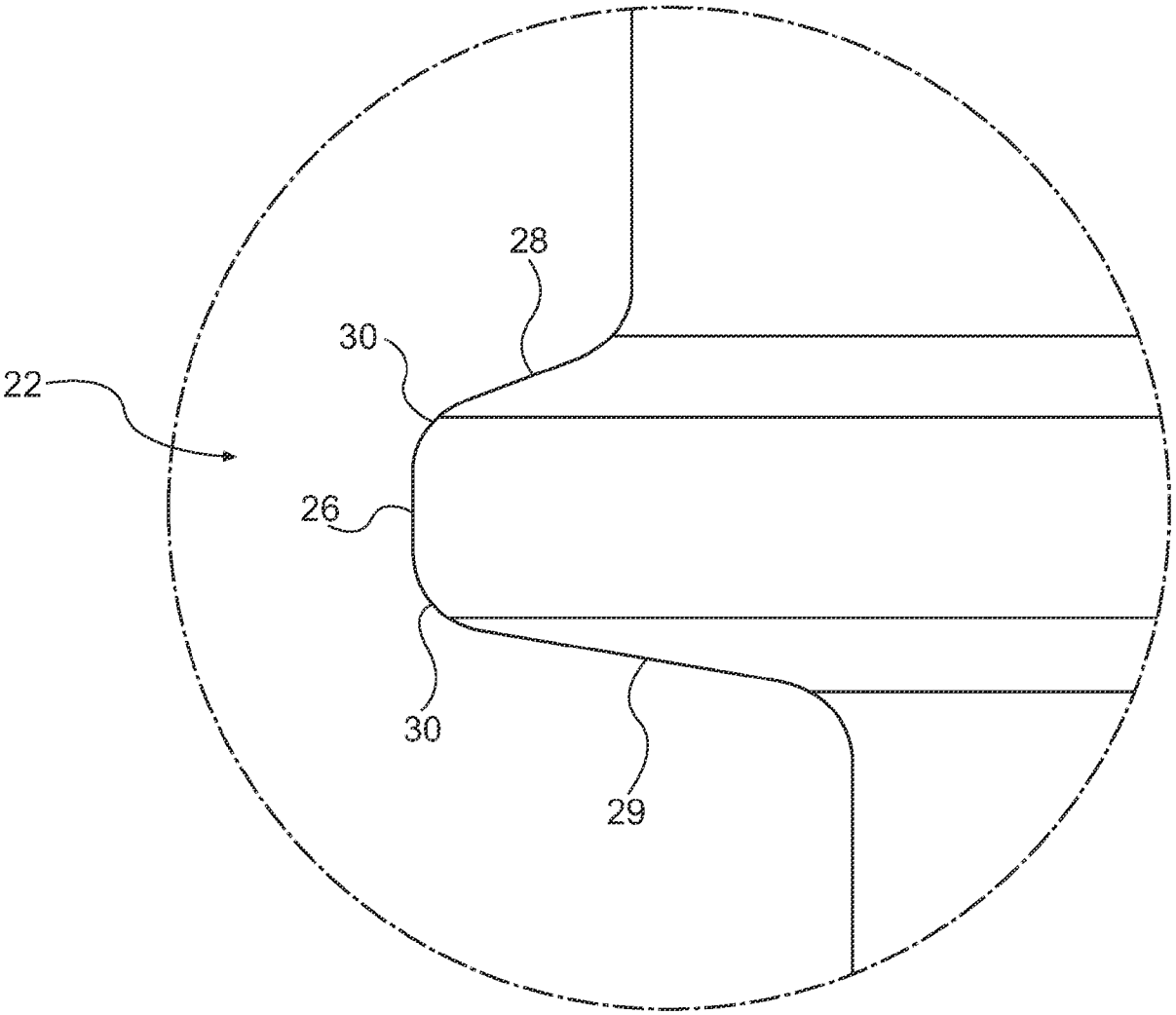
FIG. 2 is an enlarged portion of FIG. 1.
Figure 3:
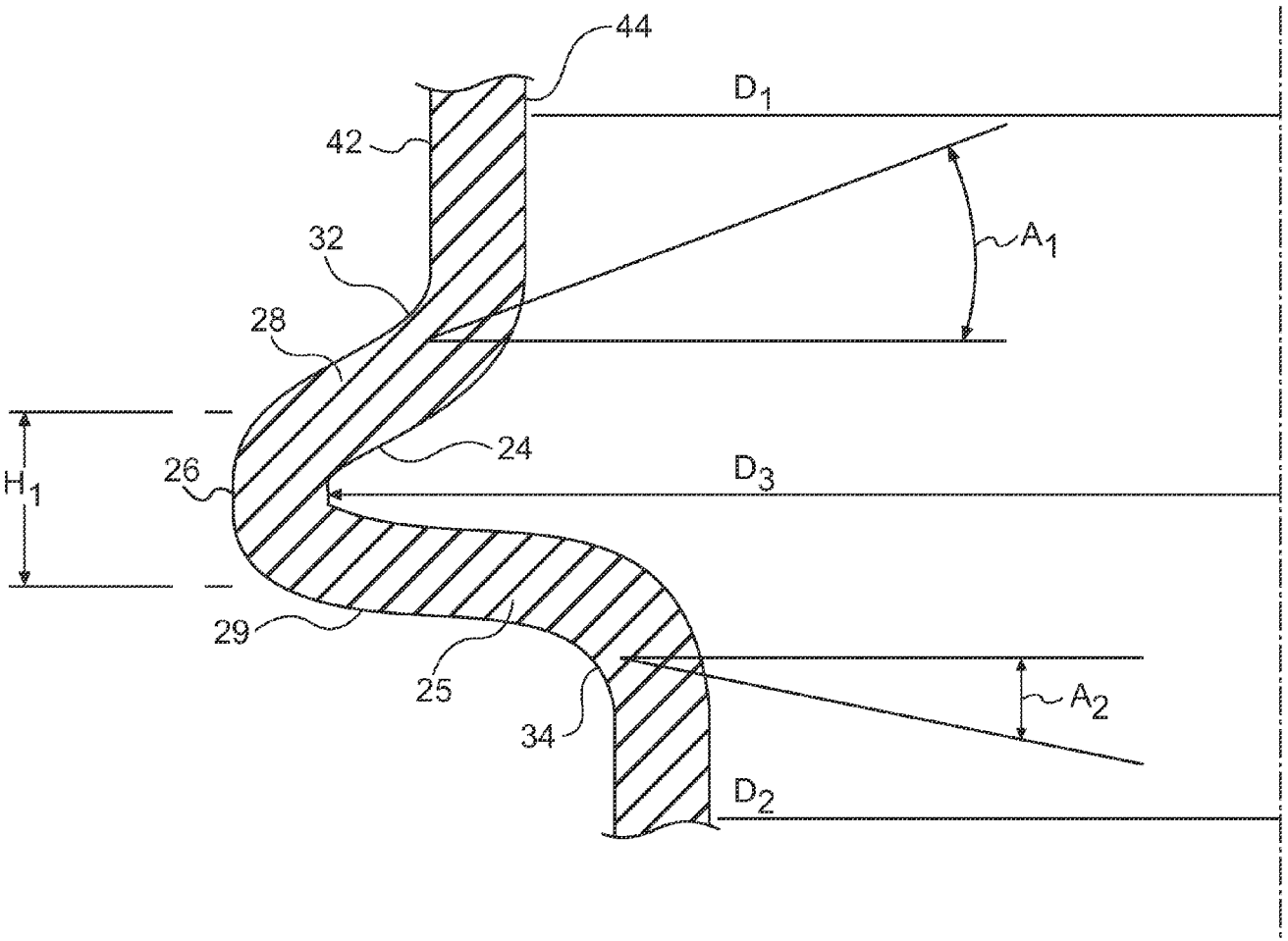
FIG. 3 is a cross-sectional view depicting the portion of the preferred embodiment of the invention that is shown in FIG. 2.

Referring now briefly to FIG. 2, it will be seen that the transfer bead 22 preferably and advantageously is shaped to have a first upper annular portion 28 that has an outer surface that when viewed in longitudinal cross-section has a shown in FIG. 3 defines a first angle $A_1$ with respect to a horizontal plane 48 that is perpendicular to the central longitudinal axis 46. Transfer bead 22 also preferably includes a second lower annular portion 29 that has an outer surface that when viewed in longitudinal cross-section as is shown in FIG. 3 defines a second angle $A_2$ with respect to the horizontal plane 48.

Preferably, the first angle $A_1$ is greater than the second angle $A_2$. The first angle $A_1$ is preferably at least 12°, more preferably at least 15° and most preferably at least 19°. The second angle $A_2$ is preferably at least 5° and is most preferably at least 9°.

Transfer bead 22 further preferably includes an outer annular portion 26 of the sidewall 25 that is oriented so as to be substantially parallel to the central longitudinal axis 46, or vertical as it is depicted FIG. 3, and that is connected to the first upper annular portion 28 of the sidewall 25 at an upper end thereof and to the second lower annular portion 29 of the sidewall 25 at a lower end thereof. The outer annular portion 26 of the sidewall 25 preferably extends for a first height $H_1$, as is best shown in FIG. 3. The first height $H_1$ is preferably at least 0.070 inches, is more preferably at least 0.075 inches and is most preferably at least 0.080 inches. The first height $H_1$ is preferably at least twice the thickness of the sidewall 25.

The areas 30 of the outer surface 42 of the sidewall 25 of the neck portion 12 where the first upper annular portion 28 and the second lower annular portion 29 intersect the outer annular portion 26 are preferably slightly rounded, preferably having a radius of about 0.030 inches. Similarly, the areas 32, 34 of the outer surface 42 of the sidewall 25 where the first upper annular portion 28 and the second lower annular portion 29 intersect adjacent areas of the neck portion 12 are preferably rounded and preferably have a radius that is approximately 0.030 inches.

As may best be seen in FIGS. 2 and 3, neck portion 12 is preferably shaped so as to have a first diameter $D_1$ above the transfer bead 22 and a second diameter $D_2$ that is different from the first diameter $D_1$ below the transfer bead 22. The first diameter $D_1$ is preferably greater than the second diameter $D_2$. A third diameter $D_3$ is defined from the central longitudinal axis 46 to the inner surface of the outer annular portion 26 of the sidewall 25.

In other words, the shape and size of the channel that is created by the inner surface 44 of the neck portion 12 in the vicinity of the transfer bead 22 has been changed with respect to conventional designs so that it is broader and more open in order to permit greater accessibility for application of the sterilization fluid and removal of the sterilization fluid from the container during the rinsing process.

Figure 4:
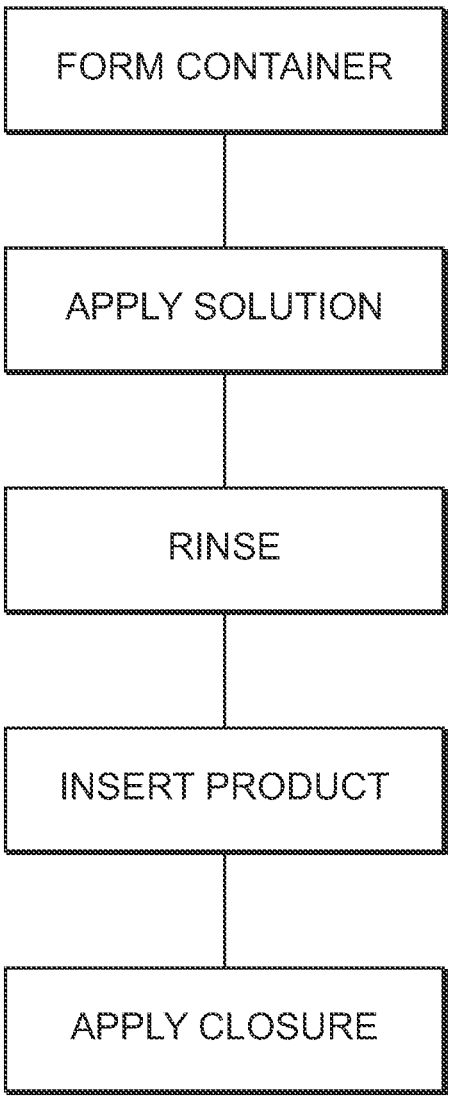
FIG. 4 is a flowchart depicting a method that is performed according to a preferred embodiment of the invention.

As is depicted in FIG. 4, a container 10 as described above would be manufactured preferably using the extrusion blow molding process and sterilizes prior to filling by immersing or spraying the interior of the container 10 including the inner surface 44 of the sidewall 25 with a sterilization solution. The sterilization solution would then be removed from the interior of the container 10 during a rinsing process. The container 10 would then be filled with the desired product in a sterile environment and sealed for commercial distribution.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of aseptically packaging a beverage, comprising:

providing a container that has a neck portion having a sidewall that defines an inner surface and an outer surface, said neck portion having a central longitudinal axis, said neck portion further having a transfer bead defined therein, wherein the sidewall has a thickness along the transfer bead, and said transfer bead is defined by:

a first upper annular portion of said sidewall, said first upper annular portion having a first outer surface that when viewed in longitudinal cross-section defines a first angle with respect to a horizontal plane that is perpendicular to said central longitudinal axis;

a second lower annular portion of said sidewall, said second lower annular portion of said sidewall having a second outer surface that when viewed in longitudinal cross-section defines a second angle with respect to the horizontal plane, said first angle being greater than said second angle; and an outer annular portion of said sidewall having an outer annular surface oriented substantially parallel to said central longitudinal axis and connected to said first upper annular portion of said sidewall at an upper end thereof and to said second lower annular portion of said sidewall at a lower end thereof, said outer annular surface of said sidewall extending for a first height and defining an outer cylindrical surface extending for the first height, wherein the first height is at least twice the thickness of the sidewall;

applying a sterilization fluid to an interior of the container;

rinsing the sterilization fluid from the container while the container is inverted to form an aseptic container; and packaging a beverage within the aseptic container.

2. A method of aseptically packaging a beverage according to claim 1, wherein said first height is at least 0.070 inches.

3. A method of aseptically packaging a beverage according to claim 2, wherein said first angle is at least 12°.

4. A method of aseptically packaging a beverage according to claim 2, wherein said second angle is at least 5°.

5. A method of aseptically packaging a beverage container according to claim 1, wherein said first angle is at least 12°.

6. A method of aseptically packaging a beverage according to claim 1, wherein said second angle is at least 5°.

7. A method of aseptically packaging a beverage according to claim 1, wherein said neck portion has a first diameter above said transfer bead and a second diameter that is different from said first diameter below said transfer bead.

8. A method of aseptically packaging a beverage according to claim 7, wherein said first diameter is greater than said second diameter.

9. A method of aseptically packaging a beverage according to claim 1, wherein said substantially constant wall thickness is within a range of about 0.025 inches to about 0.040 inches.

10. A method of aseptically packaging a beverage according to claim 1, wherein the sidewall has a substantially constant wall thickness at least along the transfer bead.

11. A method of aseptically packaging a beverage, comprising:

providing a container that has a neck portion having a sidewall that defines an inner surface and an outer surface, said neck portion having a central longitudinal axis, said neck portion further having a transfer bead defined therein, wherein the sidewall has a substantially constant wall thickness at least along the transfer bead, and said transfer bead is defined by:

a first upper annular portion of said sidewall, said first upper annular portion having a first outer surface that when viewed in longitudinal cross-section defines a first angle with respect to a horizontal plane that is perpendicular to said central longitudinal axis;

a second lower annular portion of said sidewall, said second lower annular portion of said sidewall having a second outer surface that when viewed in longitudinal cross-section defines a second angle with respect to the horizontal plane; and an outer annular portion of said sidewall that is oriented substantially parallel to said central longitudinal axis and connected to said first upper annular portion of said sidewall at an upper end thereof and to said second lower annular portion of said sidewall at a lower end thereof, said outer annular portion of said sidewall extending for a first height and defining an outer cylindrical surface extending for the first height, wherein the first height is at least twice the thickness of the sidewall;

said neck portion further having a first diameter above said transfer bead and a second diameter that is different from said first diameter below said transfer bead;

applying a sterilization fluid to an interior of the container;

rinsing the sterilization fluid from the container to form an aseptic container; and packaging a beverage within the aseptic container.

12. A method of aseptically packaging a beverage according to claim 11, wherein said first diameter is greater than said second diameter.

13. A method of aseptically packaging a beverage according to claim 11, wherein said first height is at least 0.070 inches.

14. A method of aseptically packaging a beverage according to claim 11, wherein said first angle is greater than said second angle.

15. A method of aseptically packaging a beverage according to claim 11, wherein said first angle is at least 12°.

16. A method of aseptically packaging a beverage according to claim 11, wherein said second angle is at least 5°.

* * * * *

UNITED STATES PATENT AND TRADEMARK OFFICE

CERTIFICATE OF CORRECTION

PATENT NO. : 9,120,590 B2
APPLICATION NO. : 13/488886
DATED : September 1, 2015
INVENTOR(S) : Edward Roubal and Larry Taylor It is certified that error appears in the above-identified patent and that said Letters Patent is hereby corrected as shown below:

Title Page

RELATED U.S. APPLICATION DATA:

At item (60) Related U.S. Application Data: "Division of application No. 12/047,700, filed on Mar. 13, 2009, now abandoned." should read -- Division of application No. 12/047,700, filed on Mar. 13, 2008, now abandoned. --

Signed and Sealed this
Eighth Day of March, 2016

Michelle K. Lee

Michelle K. Lee
*Director of the United States Patent and Trademark Office*